United States Patent [19]

Cohen

[11] 3,935,949

[45] Feb. 3, 1976

[54] POSITION LOCATING DEVICE FOR DISPLAY HANGER

[76] Inventor: Maurice Cohen, 3580 NW. 52nd St., Miami, Fla. 33142

[22] Filed: June 21, 1974

[21] Appl. No.: 481,898

[52] U.S. Cl. ..... 211/168; 211/96

[51] Int. Cl.[2] ..... A47F 5/12

[58] Field of Search ..... 211/96, 95, 169, 106, 171, 211/105.1, 105.2, 115, 116, 123, 124, 168; 248/475 B, 477, 478, 289, 324

[56] References Cited

UNITED STATES PATENTS

| | | | |
|---|---|---|---|
| 2,536,233 | 1/1951 | Sklarek | 248/289 X |
| 2,684,226 | 7/1954 | Sundell et al. | 211/96 X |
| 2,717,802 | 9/1955 | Martin | 248/289 |
| 2,889,128 | 6/1959 | Martin et al. | 248/324 |
| 3,346,229 | 10/1967 | Carson, Jr. | 248/477 |
| 3,384,334 | 5/1968 | Malachowski | 248/289 X |
| 3,529,799 | 9/1970 | Schaefer | 248/496 |
| 3,750,818 | 8/1973 | Borstcher | 211/95 |

*Primary Examiner*—Roy D. Frazier
*Assistant Examiner*—Terrell P. Lewis
*Attorney, Agent, or Firm*—Salter & Michaelson

[57] ABSTRACT

A device for positively locating a pivotal display hanger in a selected position of use on a support, said device having a base member that is fixed to the support and a locating member that is mounted on the end of the hanger and rotatable therewith, the locating member cooperating with the base member to provide for a step-by-step movement of the hanger when it is pivoted so that the hanger is locatable in a selected position of use.

8 Claims, 5 Drawing Figures

POSITION LOCATING DEVICE FOR DISPLAY HANGER

BACKGROUND OF THE INVENTION

The present invention has application to a display rack and to a hanger for use therewith, wherein an article is mounted for display on the hanger.

Although the rack for use with the invention as embodied herein has general application for the display of various articles such as clothing, wallpaper, rugs and other articles that can be displayed in a vertical position, the invention has particular application with a garment rack on which hangers are mounted for the display of various articles of clothing, the garment hangers being pivotally mounted on the rack.

In the display of garments such as trousers on a garment hanger as mounted on a display rack, the hanger normally includes a horizontal rod portion over which the trousers are draped for convenient inspection by a customer. In selecting a garment for closer inspection or for removal thereof from the hanger on which it is mounted, it is the usual practice to pivotally move the hangers adjacent to the one on which the selected garment is located so as to isolate the selected garment. Prior to the instant invention, garment hangers as mounted on a support or rack have been freely pivotal primarily along a vertical axis; and in most garment racks of this kind, selected hangers are isolated only after forcing the adjacent hangers away from the selected one and applying sufficient pressure on the adjacent hangers to maintain them in a position that will not interfere with inspection of the selected garment or the removal thereof from its hanger. Maintaining the garments in a compressed condition away from the selected hanger sometimes is inconvenient, and oftentimes the user will have to locate his body against the bank of hangers that have been pivoted away from the selected hanger, so as to free both hands for inspection of the selected garment or the removal thereof from its hanger. Sometimes when a garment rack is fully loaded with garments as mounted on the display hangers of the rack, moving the selected hanger to a convenient location for inspection of the garment thereon is a difficult task and is frustrating to a customer who is desirous of removing the garment from the hanger. Furthermore, replacement of the garment on the hanger is oftentimes difficult to achieve on a fully loaded rack, and quite frequently the garment as replaced on the hanger is not hung properly, which not only results in an unsightly display, but also wrinkles the garment.

SUMMARY OF THE INVENTION

The present invention relates to a display rack and more particularly relates to a locating device for use with a display rack for positively locating a pivotal display hanger in a selected position of use on the rack.

In the preferred embodiment of the invention, the display rack on which the locating device of the present invention is mounted, includes a plurality of pivotally mounted hangers thereon. The hangers normally include a horizontal support rod on which the article to be displayed is mounted, a vertical portion of the hanger being joined to the horizontal portion thereof and defining the pivot axis of the hanger. The position locating device as embodied herein includes a base member that is fixed to the display rack and further includes a locating member that receives the vertical portion of the hanger therein. The locating member interfits with the base member and is rotatable relative thereto, detent means being formed on the base and locating member so as to provide for step-by-step rotation of the locating member and the hanger fixed thereto relative to the base member and the support or rack on which the base member is mounted. The step-by-step rotation of the locating member and the hanger to which it is secured provides for movement of the hanger to a selected position of use relative to the hangers mounted on the rack adjacent thereto.

Accordingly, it is an object of the present invention to provide a display rack having a plurality of hangers mounted thereon, each of which is movable to a selected position of use.

Another object of the invention is to provide a device for use in a display rack that positively locates a pivotal hanger in a selected position of use on the rack, the device enabling the hanger to be selectively moved in a manner that will locate it in spaced relation with respect to the adjacent hangers mounted on the rack.

Still another object is to provide a locating device for use with a hanger as mounted on a support, the locating device including a base member fixed to the support and a locating member fixed to the hanger, the locating member being interfitted in the base member and being movable in step-by-step relation relative thereto, thereby providing for step-by-step movement of the hanger to a selected position of use.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
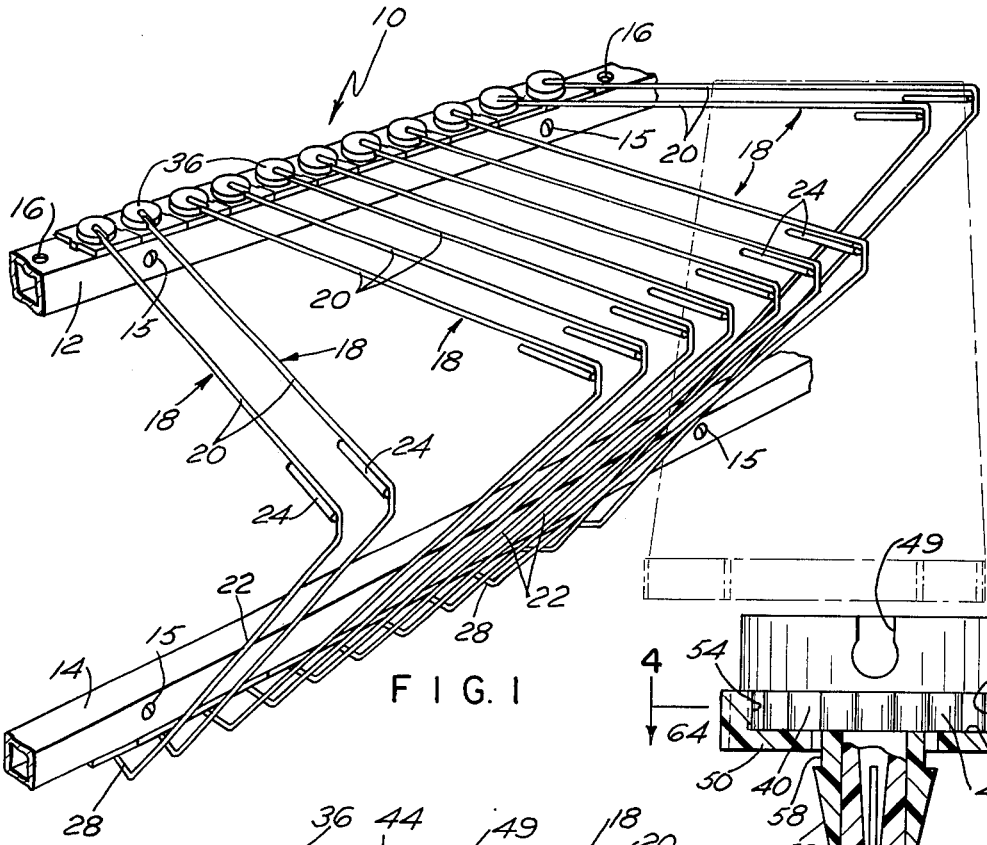
FIG. 1 is a perspective view showing a portion of a display rack having garment hangers mounted for pivotal movement thereon, each of the hangers being interfitted with a locating device as embodied in the present invention.
Figure 2:
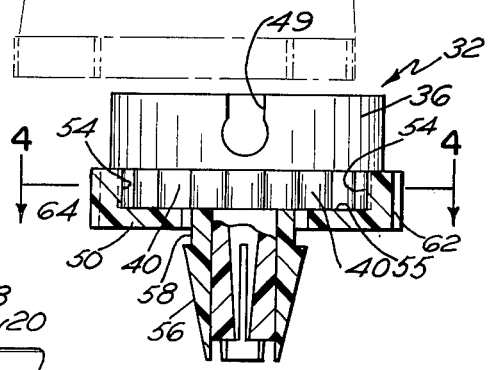
FIG. 2 is a sectional view of the locating device as embodied herein.

Referring now to the drawing and particularly to FIG. 1, a portion of a display rack as embodied in the present invention is illustrated and is generally indicated at 10. As shown, the display rack 10 includes an upper horizontal rail 12 below which is spaced a corresponding lower horizontal rail 14. The rails 12 and 14 may be secured to a support or base of a display rack or may be directly mounted on a vertical surface thereby consituting the support structure of the rack. It is also understood that the rails 12 and 14 may be formed in a circular configuration, or any other known configuration normally used in display racks. As shown the rails 12 and 14 are fixed to a support structure or wall by convenient fastening means such as screws 15. As further illustrated in FIG. 1, the uppermost surface of the rail 12 is formed with a plurality of spaced openings 16 therein, the spacing and purpose of which will be described hereinafter. The lower surface of the rail 14 is formed with aligned corresponding openings therein which are located in approximately the same spaced relation as those openings 16 formed in the rail 12.

Formed as part of the display rack 10 and mounted for pivotal movement with respect to the rails 12 and 14 are a plurality of garment hangers 18. Each of the garment hangers 18 is of the two-point suspension type and includes a horizontal rod portion 20 to which is joined an inclined downwardly extending rod portion 22. A shortened rod 24 is secured to a portion that interconnects the horizontal rod portion 20 and the inclined rod portion 22, and is designed to retain an article in place on the horizontal rod portion 20. As more clearly illustrated in FIG. 3, a downwardly extending upper vertical portion 26 is joined to the horizontal rod portion 20 of each hanger 18 and projects downwardly at right angles with respect thereto. A lower vertical portion 28 (FIG. 1) is also joined to the inclined portion 22 of each hanger 18 and cooperates with the upper vertical portion 26 to pivotally mount a hanger 18 in place on the rails 12 and 14. For an additional description of the hanger 18 and the function and purpose thereof, reference is made to U.S. Pat. No. 2,944,675.

Although the two-point suspension hanger 18 is illustrated as used in connection with the locating device of the present invention, it will be understood from the following description that a single-point suspension hanger may be utilized with the locating device wherein the single-point suspension hanger would be mounted on a single upper rail 12 without departing from the spirit of the invention.

Figure 3:
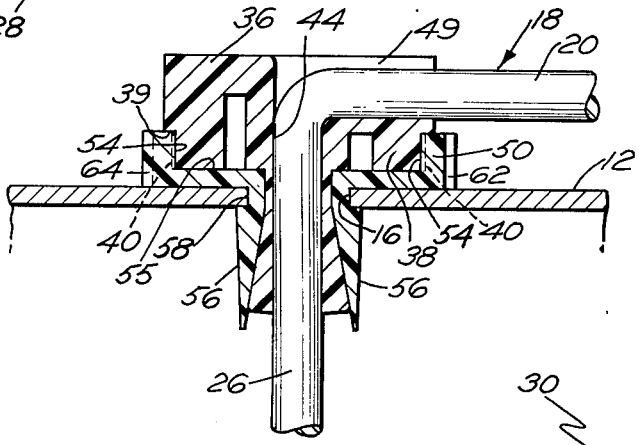
FIG. 3 is a sectional view of the locating device mounted on a support rail and receiving the end of a hanger therein.
Figure 4:
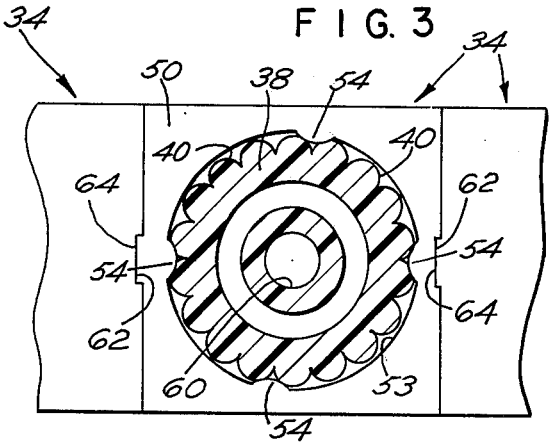
FIG. 4 is a sectional view taken along line 4—4 in FIG. 2.
Figure 5:
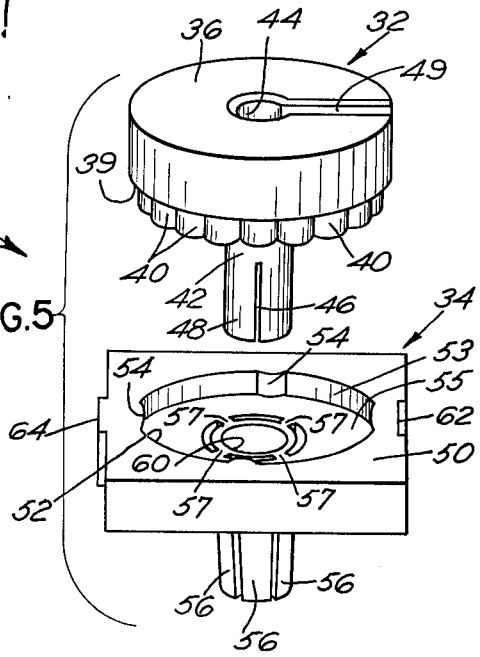
FIG. 5 is an exploded perspective view of the locating device.

The purpose and main object of the invention is to provide for movement of the hangers 18 in a step-by-step motion to selectively locate any one of the hangers 18 in a desired position of use within the limits of the pivotal movement thereof. In order to accomplish this purpose, a locating device generally indicated at 30 in FIG. 5 is provided and includes a locating member generally indicated at 32 that interfits with a base member generally indicated at 34. The locating member 32 includes a disc-shaped head portion 36 on the undersurface of which a reduced diameter annular rim 38 is formed that defines a shoulder 39 with the periphery of the head portion 36. As illustrated in FIGS. 4 and 5, a plurality of rounded teeth 40 are formed on the peripheral edge of the annular rim 38; and as will be described, the teeth 40 provide for the step-by-step movement of the hanger 18. Formed centrally of the locating member 32 and projecting downwardly from the midpoint of the head 36 is a shank 42. Extending through the head 36 and into the shank 42 is a bore 44 that receives the vertical portion 26 of the hanger 18 therein. The lowermost end of the shank 42 is provided with slits 46 that divide the shank into four resilient portions 48. The resilient portions 48 define an opening therebetween that represents a continuation of the bore 44, the resilient portions 48 yieldably spreading apart when the vertical portion 26 of the hanger 18 passes through the opening as formed in the shank 42. As illustrated in FIG. 3, the vertical portion 26 of the hanger 18 extends completely through the head portion 36 and shank 42 for frictionally mounting the locating member 32 on the base member 34. Also formed in the head portion is a cross slot 49 that extends from the periphery of the head portion 36 to the bore 44. The bottom wall of the slot 49 is concave; and, as illustrated in FIG. 3, the horizontal rod portion 20 of the hanger 18 is snugly received in the slot 49 to lock the locating member 32 on the hanger 18.

The base member 34 includes a square-shaped plate-like base 50 having a circular-shaped recess 52 formed therein, defined by a circular wall 53 and a bottom wall 55. Formed on the wall 53 of the recess 52 at 90° intervals are rounded projections 54 that cooperate with the rounded teeth 40 as formed on the locating member 32 to provide for the step-by-step motion of the locating member 32 with respect to the base member 34. The diameter of the recess 52 is dimensioned for frictionally receiving the reduced diameter annular rim 38 of the locating member 32 therein. As illustrated in FIG. 3, the shoulder 39 engages the upper surface of the base 50 to provide for rotatable movement of the locating member 32 with respect to the base member 34. Thus, when the annular rim 38 is disposed in the recess 52, each of the projections 54 as formed on the wall of the recess 52 is located between a pair of the teeth 40 as formed on the annular rim 38.

In order to mount the base member 34 of the locating device in place on a rail, a plurality of tapered fingers 56 are provided; and as illustrated in FIG. 1, the fingers 56 which are spaced apart, generally define a truncated cone that is joined to the plate member 50 by reduced sections 58.

The reduced sections 58 are connected to the bottom wall 55 of the recess by webs 57 that are joined to a circular web that defines an opening 60, the opening 60 being formed in the bottom wall 55 and communicating with the bore as defined between the split fingers 56. The split fingers 56 are flexible so as to provide for entry of the shank 42 and vertical portion 26 therein when the locating member 32 and hanger 18 are mounted in place on the base member 34. In order to orient the base members 34 in place as mounted on the rails 12 and 14, the plate member 50 is formed with a notch 62 on a side thereof and a corresponding projection 64 on the opposite side. As shown in FIG. 4, when the base members 34 are located in side-by-side relation, the adjacent notches 62 and projections 64 interfit to properly orient the base members. It is understood that the openings 16 are appropriately spaced apart to accommodate the fingers 56 of the base members therein.

Both the locating member 32 and the base member 34 are molded in a one-piece construction of a plastic material. Any suitable plastic material may be used in molding the members, such as polyethylene, polypropylene, Delrin or ABS, the only requirement being that the finished members the sufficiently rigid to accommodate the hanger 18 and to be sufficiently flexible to enable the locating member 32 to be moved relative to the base member 34 for producing the step-by-step pivotal movement of the hanger 18 as will be described, and to provide the required flexibility for fingers 56 and shank 42.

In mounting the base members 34 on either of the rails 12 or 14, the fingers 56 of each base member 34, which as described have a truncated cone configuration, are received in an opening 16 as formed in a rail. Downward pressure on the base member 34 forces the fingers 56 inwardly of the opening 16 until the edge of the opening 16 snaps between the fingers 56 and the underside of the bottom wall 56 of the recess 54, as defined by the reduced portions 58. As shown in FIG. 3, the base member 34 has been positively secured in place in the opening 16 by inserting the flexible fingers 56 therein and pressing downwardly on the plate member 50.

The locating element 32 and hanger 18 as mounted thereon are frictionally secured to the base member 34 by inserting the shank 42 into the opening 58 and forcing the shank 42 downwardly between the fingers 56. As the vertical portion 26 of the hanger 18 is pushed between the resilient portion 48, these resilient portions are forced apart into contact with the fingers 56. The annular rim 38 of the head portion 36 in this position is received within the recess 52 of the base member 34, the teeth 40 formed on the rim 38 straddling a projection 54 therebetween.

It is understood that locating devices 30 are positioned in both of the rails 12 and 14 in oppositely aligned relation, wherein the vertical portions 26 and 28 of the horizontal and inclined rod portions 20 and 22 of each hanger 18 are received in a locating device in a manner as described above. As previously mentioned, only a single horizontal rod portion of a hanger need be utilized if for any reason single-suspension hangers are mounted on the rack.

Since the horizontal rod portion 20 of the hanger 18 is received in the slot 49 as formed in the head portion 36 of the locating member 32, and the vertical portion 26 extends through the shank 42 and between the fingers 56 of the base member 34, a pivotal movement of the hanger 18 will cause the locating member 32 to move therewith relative to the base member 34. As the hanger 18 pivots in response to a force applied by a user, the locating member 32 rotates within the recess 52, the cooperation of the teeth 40 and the projections 54 that are frictionally engaged producing a step-by-step movement of the locating member 32 relative to the base member 34. It is seen that any one of the hangers 18 may be selectively moved to a desired position relative to the adjacent hangers, while the adjacent hangers may be movable away with respect to the selected hanger. The selected hanger will then remain in the isolated position of use as selected and because the locating device 30 will retain the hanger in its selected position, through the interaction of the teeth 40 and projections 54, the user may inspect a garment on the hanger 18 or remove it therefrom without interference from the adjacent hangers and garments mounted thereon. Each hanger 18 can only be moved when a sufficient force is applied thereto to overcome the frictional resistance between the teeth 40 and the projections 54.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for positively locating a pivotal display hanger in a selected position of use on a support, comprising a base member fixed to said support, a locating member mounted on an end of said hanger and rotatable therewith upon pivotal movement of said hanger, means formed on said locating member cooperating with means formed on said base member to provide for step-by-step pivotal movement of said hanger, wherein said hanger is positively locatable in the selected position of use, the means as formed on one of said members including a generally circular recess, on a wall of which at least one projection is formed, the means as formed on the other member including an annular portion that is receivable in said recess for rotation therein, a plurality of teeth formed on said annular portion that engage the projection in said recess to provide for the step-by-step movement of said hanger, said base member being formed with the generally circular recess therein, and said locating member being formed with the annular portion thereon, said base member having a central opening formed therein, said locating member having a central opening formed therein that is aligned with the opening in the base member when said members are interfitted, the end of said hanger being defined by a vertical rod portion that is received in the aligned openings of said members, and a slot formed in said locating member for receiving a horizontal portion of said hanger for positively locating said locating member on said hanger and providing for rotating movement of said locating member upon pivotal movement of said hanger, said base member including a plate-like portion in which said recess is formed, and a plurality of resilient fingers joined to said plate-like portion on the underside thereof and extending into an opening formed in said support for locating said base member on said support.

2. A device as claimed in claim 1, each of said fingers having an upper undercut portion formed thereon adjacent to the underside of said plate-like portions wherein a generally annular reduced neck portion is defined by said fingers and plate-like portion, said reduced neck portion receiving the edges of the opening of the support therein to lock said base member on said support.

3. A device as claimed in claim 2, said locating member including a central shank that depends centrally of said annular portion, said central shank having an opening extending therethrough through which the vertical portion of said hanger extends, and said shank and hanger extending therethrough being received between the fingers of said base member in friction locking relation.

4. A device as claimed in claim 3, said base member having a notch formed in a side wall thereof and a projection formed on an opposite wall thereof, said notches and projections engaging corresponding projections and notches in adjacently located base members to orient said base members on a support.

5. A device for positively locating a pivotal display hanger in a selected position of use on a support wherein said hanger includes a vertical portion about which the hanger is pivoted, comprising a base member fixed to said support, said base member having a central opening formed therein and having at least one projection formed thereon, a locating member having a central opening formed therein that receives the vertical portion of said hanger in friction fitting relation for fixedly mounting said locating member on said hanger, the vertical portion of the hanger extending into the central opening in said base member for rotatably mounting said locating member on said base member in operating position without the removal of engagement therewith, and a plurality of teeth formed on said locating member that are successively engageable with said projection upon rotating movement of said hanger and locating member mounted thereon, wherein said hanger and locating member are rotatably movable in a step-by-step motion with respect to said base member without removing the locating member from engagement with said base member.

6. A device as claimed in claim 5, said base member having a generally circular recess formed therein on a wall of which said projection is formed, said locating member including an annular portion on which said teeth are formed that is receivable in said recess, wherein said teeth are successively engageable with the projection upon rotating movement of said hanger and the locating member mounted thereon.

7. A device as claimed in claim 6, each of said teeth having a rounded configuration that provides for sliding frictional movement of said projection thereover to effect the step-by-step rotation of said hanger.

8. A device as claimed in claim 7, said locating member having a slot formed in the upper surface that receives a horizontal portion of said hanger when the vertical portion of said hanger is fully inserted into the openings in said locating member and base member, wherein said hanger is positively locked to said locating member to effect a rotating movement thereof relative to said base member upon pivotal movement of said hanger.

* * * * *